US005127325A

United States Patent [19]

Fadner

[11] Patent Number: 5,127,325

[45] Date of Patent: Jul. 7, 1992

[54] HYDROPHOBIC AND OLEOPHILIC MICROPOROUS INKING ROLLERS

[75] Inventor: Thomas A. Fadner, La Grange, Ill.

[73] Assignee: Rockwell International Corporation, El Segundo, Calif.

[21] Appl. No.: 689,087

[22] Filed: Apr. 19, 1991

Related U.S. Application Data

[63] Continuation of Ser. No. 345,065, Apr. 27, 1989, abandoned.

[51] Int. Cl.[5] ..... B41F 31/26

[52] U.S. Cl. ..... 101/348; 29/121.8; 29/132; 29/895

[58] Field of Search ..... 101/348, 349, 350, 147, 101/148, 450.1, 451, 452; 427/333, 384, 230; 29/121.1, 121.8, 132, 895, 895.3, 895.32, 895.33

[56] References Cited

U.S. PATENT DOCUMENTS 4,301,730 11/1981 Heurich et al. ..... 101/483 X
4,566,938 1/1986 Jenkins et al. ..... 101/348 X
4,567,827 2/1986 Fadner ..... 101/348 X

FOREIGN PATENT DOCUMENTS 44394 3/1985 Japan ..... 101/348

*Primary Examiner*—Clifford D. Crowder
*Attorney, Agent, or Firm*—C. B. Patti; V. L. Sewell; H. F. Hamann

[57] ABSTRACT

An inking roller or ink metering roller comprised of a base roller, a substantially continuous hard and wear-resistant microporous ceramic coated layer bonded to the base roller and an interdiffused and immobilized oleophilic and hydrophobic essentially organic polymeric based material affixed to the surfaces and interstices of the microporous layer.

15 Claims, 2 Drawing Sheets

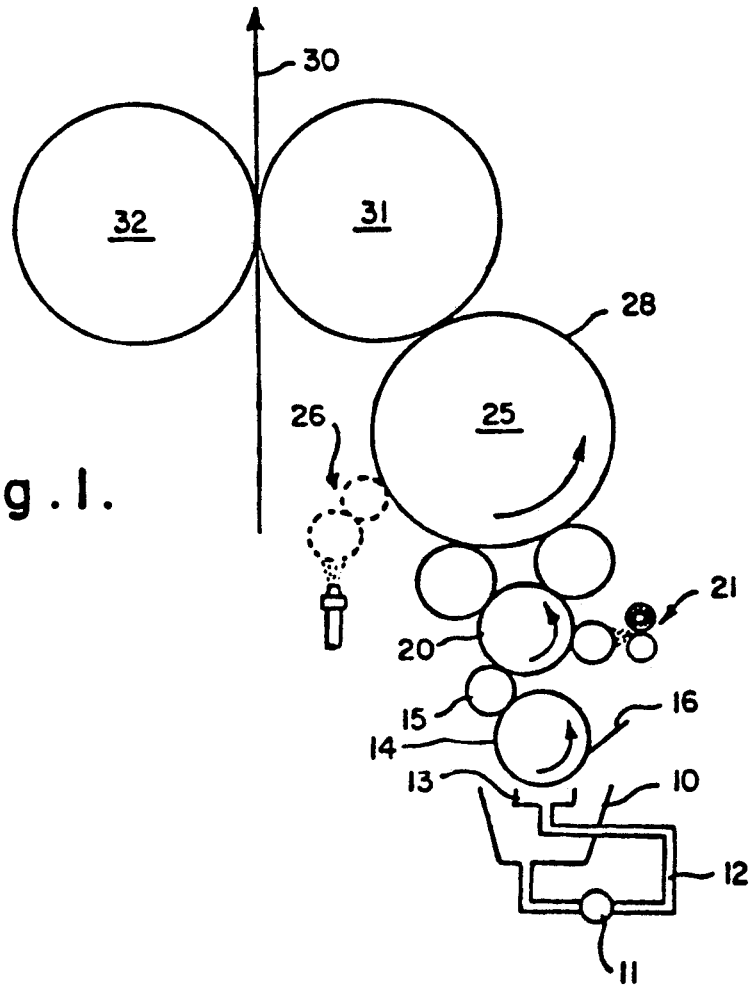
Fig. 1.
Fig. 2.
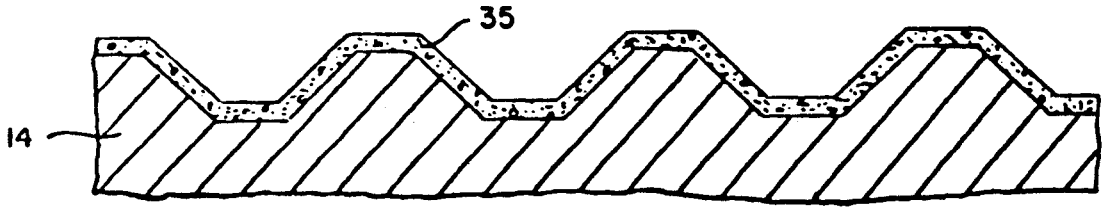
Fig. 3.
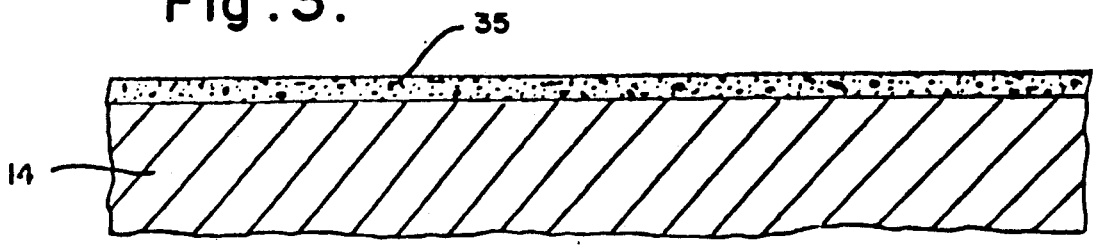

HYDROPHOBIC AND OLEOPHILIC MICROPOROUS INKING ROLLERS

This is a continuation of application Ser. No. 345,065, filed Apr. 27, 1989, now abandoned.

BACKGROUND OF THE INVENTION

In the practice of keyless inking for lithographic printing whereby ink is metered into the printed system by means of a metering roller and a cooperating scraping blade, Fadner in U.S. Pat. No. 4,601,242, Fadner and Hycner in U.S. Pat. No. 4,537,127 and Fadner in U.S. Pat. No. 4,603,634 have disclosed advantageous method and means wherein the surface of an ink metering roller will possess the dual property of being both hydrophobic and oleophilic, that is water-repelling and oil attracting. This dual property can be present whether the lithographic ink metering roller surface is formed with ink retaining dimensioned cells or is formed with a surface possessing irregularly spaced cavities capable of retaining ink. In practicing keyless inking the presence of oleophilic and hydrophobic properties at the surface of the ink metering roller is vital, since lithography requires the presence of water in the films of ink being used. The presence of hydrophilic, or water attracting regions on the ink metering roller surface will allow water to displace or debond ink from those regions, thereby disrupting the roller's ink carrying and ink metering capabilities.

The above-named Fadner, et al, prior art references also teach that even when consistent ink metering is assured by providing a metering roller surface that is both hydrophobic and oleophilic, the water contents of the ink films on the inking rollers may vary across the press width, depending upon the relative amounts of ink and water consumed in satisfying the format being printed. To accomplish uniform ink availability across the press during a printing run, it is necessary to assure that a constant ink composition is continuously available to all portions of the printing plate. Unless constant ink composition is available across the press width, the water content tends to increase in regions of low print density and undesirable print quality occurs. Means for obtaining press wide uniformity of ink composition are disclosed in the Fadner, et al U.S. Pat. No. 4,690,055.

When hydrophilic regions are purposefully included in either a random or in geometrically uniform manner, such as the land areas of the celled metering roller disclosed in U.S. Pat. No. 4,637,310 by Sato and Harada or as in the non-celled or smooth-surfaced metering roller disclosed in U.S. Pat. No. 4,287,827 by Warner, it might be reasoned that predictability of ink metering will be achieved because any water interference due to debonding of ink from the hydrophilic regions would be in accord with the pattern selected when forming the hydrophilic regions. However, the through-puts of water and ink across the press width and therefore the relative amounts of each required, are determined by the image and non-image format on the printing plate being used at any given time. Printing formats are not uniform generally and are rarely the same from press-run to press-run. Consequently, the extent of ink debonding by water when operating an apparatus utilizing the oleophilic and hydrophilic technology will depend upon the instantaneous amounts of water present in the ink at various locations on the metering roller. These locations correspond in turn to the various cross-press ink and water amounts required to print the format on the printing plate. The higher the water content in the ink at a hydrophilic/region, the greater will be the propensity for loss of ink carrying capability because of debonding of ink in the corresponding localized region. The result is variable ink input from press-run to press-run as the printed format is changed, with concomitant printed regions of unexpectedly low or unexpectedly high optical density.

Hard ceramic materials, such as chromium and aluminum oxides and tungsten carbide are naturally high energy materials and correspondingly tend to be hydrophilic in the presence of water and tend to be oleophilic in the presence only of oily materials. Metering rollers manufactured using these materials, while often used successfully in conjunction with either water based inks or with oil based inks in letterpress printing, fail to deliver consistent quantities of ink during lithographic printing utilizing oil-based inks having water present. The extent of ink delivery inconsistency is determined by whether water present in the ink has displaced or debonded ink from the roller's ceramic surface. As previously noted, the extent of debonding depends upon the water content of the ink at any selected cross-press location, which water content in turn depends upon the format being printed.

The previously referred to Fadner U.S. Pat. No. 4,601,242 discloses one means to use the advantageously hard and wear-resistant ceramic property to obtain reasonably long lithographic ink metering roller lifetimes. Specifically, ceramic powder, and in particular alumina, is flame sprayed in a purposefully thin layer of less than about 2 mils thickness over a copper-plated metering roller base. Copper is naturally hydrophobic and oleophilic. This procedure results in a hard, wear-resistant surface that has sufficient inter-particle porosity relative to ink and water interactions that the surface acts as if it was copper, therefore retaining ink in preference to water, yet simultaneously acts as a wear-resistant ceramic material relative to scraping blade wearing action. Although commercially viable, this type of roll has a lifetime on a printing press of about 20 to 30 million printing impressions, because the ceramic layer must be kept relatively thin to assure that the oleophilic property of the underlying copper is not negated by the hydrophilic properties exhibited by the ceramic layer. Further, the ceramic layer, which is naturally hydrophilic, may become increasing hydrophilic due to accumulation of contaminants associated with use and cleaning of printing presses.

A primary object of this invention is to provide a simple, inexpensive ink metering roller that ensures long operational lifetimes in keyless lithographic printing press systems where the presence of water in the ink is involved.

An additional object of this invention is to provide a process for producing an ink metering roll having a microporous wear-resistant surface layer that is infused with a chemically inert substantially organic material that is oleophilic and hydrophobic.

Still another object of this invention is to provide means whereby hard and wear-resistant but naturally hydrophilic ceramic materials can be used as part of a composite layer that has hydrophobic and oleophilic properties without detracting from their naturally excellent wear-resistant quality.

A further object of this invention is to provide an improved inking roller having a composite structure that combines high degrees of wear resistance with a preferential attraction for and retention of oil inks in the presence of water.

Other objects and advantages of this invention will be in part obvious and in part explained by reference to the accompanying specification and drawing in which:

DESCRIPTION OF THE DRAWINGS

FIG. 1 is a schematic side elevation of keyless lithography printing system configuration illustrating a lithographic printing arrangement incorporating an ink metering roll of the present invention;

FIG. 2 is a sectional view through a portion of the roll of this invention showing the infused, wear resistant surface in which recesses to hold ink are provided;

FIG. 3 is a sectional view similar to FIG. 2 but with a roller having no individually formed ink receiving recesses;

SUMMARY OF THE INVENTION

Figure 4:
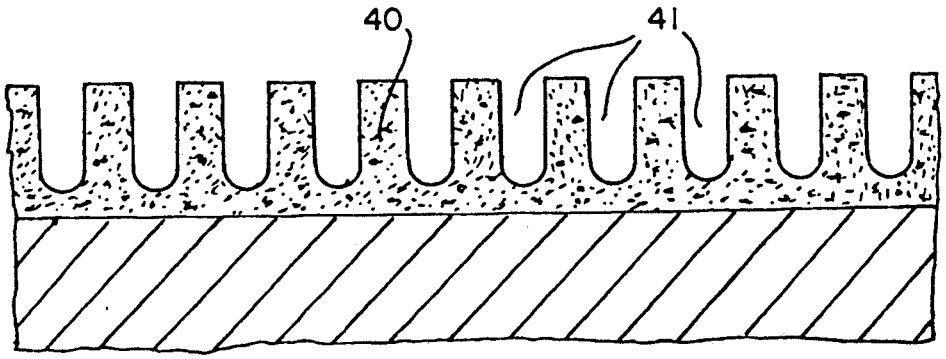
FIG. 4 is a sectional view similar to FIG. 3 showing a variation in the shape of individually formed ink receiving recesses.

This invention relates to an improved ink metering roll for metering ink in modern, high-speed lithographic printing press systems, and to an inking system wherein keyless means are provided to simplify the inking system and to simplify the degree of operator control or attention required during operation of the printing press.

Typically, a press using a keyless inking system will comprise an ink reservoir or sump 10, a pump 11 and piping 12 interconnecting an ink pan 13, within which a metering roller 14 is located, to supply ink to a frictionally driven ink transfer roller 15. A reverse angle scraping or metering blade 16 operates against the metering roller 14 to remove all of the ink on the metering roller 14 except that in cells or interstices, when present. Ink from transfer roller 15 is passed onto a substantially smooth inking drum 20 where it is combined with water supplied from dampener 21. Dampening fluid can be supplied by any appropriate means, either to the ink roll 20 as shown or directly to the plate roll 25, as indicated by the phantom lines at 26. The scraping blade 16 (or other ink removal means) operating against the metering roll 14 is present to continuously remove substantially all of the excess ink film therefrom. All of the aforesaid elements function to supply a uniform film of ink to the printing plate 28 mounted on press driven plate cylinder 25. The plate or cylinder 25 in turn supplies ink in the form of an image, for example, to a paper web 30 being fed through the printing nip formed by the coacting blanket cylinder 31 and impression cylinder 32. All of the rollers in FIGS. 1 and 2 are configured substantially axially parallel.

Many other press configurations can be visualized by those skilled in the art and science of keyless lithographic printing, the primary features that are important for proper operation of this invention are discussed below.

The amount of ink reaching the printing plate may be controlled by the dimensions of depressions or of ink receiving cells formed in the surface of the ink metering roller in conjunction with a coextensive scraping or doctor blade that continuously removes virtually all of the ink from the celled metering roller except that carried in the cells or recesses.

The ink metering roller is composed of a steel or aluminum or comparable core material of suitable strength, length and diameter that is suitably coated with a relatively thick wear-resistant ceramic material. While the roll surface need not be engraved in all instances laser engraving can be used to form accurately dimensioned and positioned cells or recesses, which cells together with a scraping doctor blade serve to precisely meter a required volume of ink. To ensure accurate and continuous metering of ink by all regions of the roller surface for the wear-related useful lifetime of the roller, the ceramic materials are infused with highly fluid dilute solutions or suspensions of chemically inert or non-reactive normally solid organic materials that exhibit hydrophobic and oleophilic properties. The organic normally polymeric substances remain in the interstices of the ceramic matrix after the fluid carrier is removed for example by evaporation.

FIG. 2 is a cross-sectional view of one form of this invention in which the base roller used to produce metering roller 14 is engraved before application of the ceramic coating indicated by numeral 35.

The celled metering roller 14 illustrated in the drawings, may be, as previously mentioned, mechanically-engraved and then coated with the ceramic layer or may be first coated with ceramic and then laser-engraved to form patterned cells or depressions in the coated surface of the roller. The volume and frequency of the depressions are selected based on the volume of ink required to meet the printed optical density specifications and in accordance with known practices. Other means of forming cells or interstices that when made hydrophobic and oleophilic according to this invention will preferentially carry ink in the presence of water may be visualized.

Roller 14 is employed typically together with a scraping or doctoring blade 16 to meter the input of ink into the press system. Roller 20 may instead be employed as the metering roller to allow positioning the metering roller as the metering roller closer to the printing plate and in that case function together with a scraping blade, as shown at roller 14, to remove from the printing system virtually all of used return ink that exists at that location. In either case the return film of ink, that is the unused portion of the input ink, is continuously scraped off and led to sump 10 for subsequent continuous recirculation by pump 11 back to the celled metering roller 14 or 20. Many of these keyless lithography press operational elements are described in more detail in Fadner, et al U.S. Pat. No. 4,690,055.

I have found that the commonly available hard, wear-resistant ceramic and ceramic-like materials such as alumina, tungsten carbide or chromium oxide, all of which are available for manufacture of an inking roller, prefer to have a layer of water rather than a layer of oil-based ink on their surfaces when both liquids are present. Although various ceramic materials are known to function as the hard, wear-resistant uppermost surface of ink metering rollers either for a printing system such as letterpress involving a single oil-based printing fluid or for flexographic printing systems using a single water-based inking fluid, these same ceramic surfaces when used in lithographic printing will become debonded of an oil or resin-based ink whenever sufficient dampening water penetrates through the ink to the roller. This is more readily understood if one considers that hydrophilic or water-loving surfaces such as ceramic materials are, in the absence of water, oleophilic or oil loving. When fresh, unused, water-free lithographic ink is applied to a ceramic, the ink initially exhibits good adhesion to and wetting of the roller surface. Under these initial conditions, normal ink-metering performance is observed. However, during lithographic printing operations, as the water content in the ink increases, a condition is reached where a combination of roller nip pressure and increasing water content in the ink force water through the ink layer to the ceramic metering roller surface. By adhering preferentially to the roller's surface, the water debonds the ink from that surface, thereby disallowing subsequent pickup of ink from the ink input means.

I have found that water-interference problems associated with using state-of-the-art ceramic-covered rollers to meter ink in keyless lithographic inking system can be avoided by infusing into the interstices of a microporous layer of ceramic material a chemically inert essentially solid organic material that possesses oleophilic and hydrophobic properties. Ceramic rollers thus treated function as metering rollers in lithographic printing systems without the aforementioned chemically-related ink metering failure.

In one form of this invention a steel or aluminum or other suitable roller may be mechanically engraved in patterns similar for instance to those shown in FIG. 2, then flame-spray ceramic coated to the maximum thickness that substantially retains the cell structure originally present in the core's surface, about 5 to 8 mils. The deposition process normally requires repeated thin-application passes of the ceramic coating apparatus, and may be followed by infusion with a selected organic substance, as elsewhere described herein. In the case of a base roller manufactured of aluminum, the roller can be given a hard anodizing treatment to form the ceramic-like layer in situ before application and infusion of the polymer in solution.

Alternatively, the roller core is similarly mechanically engraved, then one-pass flame-spray coated with a thin film of ceramic powder to a coating thickness typically less than about 0.1 to 0.2 mil, then infused with the solution of organic oleophilic and hydrophobic polymeric material, then freed of solvent to solidify the polymer then given another ceramic coating pass, then another infusion and solidification treatment and so on until the desired 5 to 8 mil thick ceramic coating is built-up by successive coating and infusion treatments.

Figure 5:
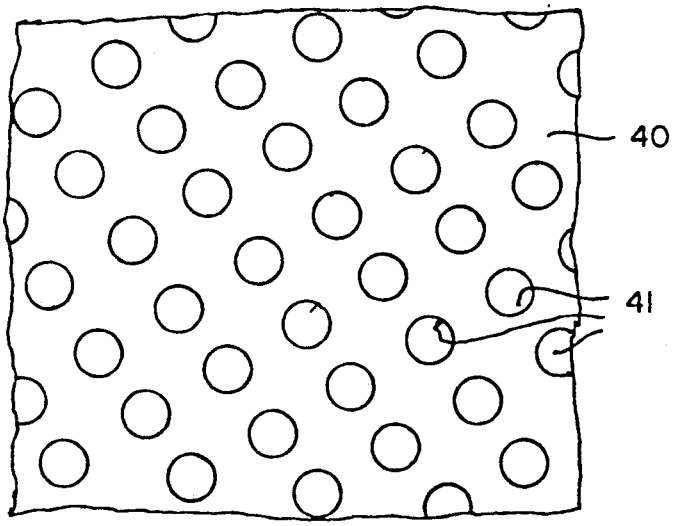
FIG. 5 is a plan view of FIG. 4.

The desired microporous layer can be obtained also by subjecting a steel or aluminum roller core to a multiple-press flame-spray coating with the selected ceramic particles to build up a thick, from 3 to about 10 mil or more coating. This coating, such as indicated by numeral 40 in FIGS. 4 and 5, is then laser engraved to create cell patterns 41 for instance as depicted in FIGS. 4 and 5, after which the organic oleophilic and hydrophobic material is infused into the ceramic surface by means already described.

The same sort of structure can be obtained where the solution of the organic oleophilic and hydrophobic is applied and dried after each flame-spray coating pass in a series of about 6 to 20 or so sequences, to achieve the desired organic/ceramic coating thickness which then exhibits oleophilic and hydrophobic properties, followed by laser engraving to create the required ink carrying capacity.

Several types of chemically inert organic oleophilic-hydrophobic materials can be used. These materials are generally dissolvable solid or semi-solid polymers that are liquids when appropriately dissolved in a solvent and can therefore be applied by mist, spray, dip or other well known application methods. A primary objective in applying the normally solid oleophlic and hydrophobic material as a rather fluid solution is to render as much as possible of the microporous ceramic powder coating surfaces oleophilic and hydrophobic by penetration of the oleophilic and hydrophobic organic as deep into interstices or voids in the ceramic coating as possible. Highly mobile liquid systems are preferred. Simple spray-painting techniques are appropriate as are dip-coating with roller rotation. Dilute solutions of the oleophilic and hydrophobic organic in solvents that allow seconds to minutes open-time will help to provide penetration deep into the interstices of the ceramic coating.

In all cases, the oleophilic and hydrophobic material is rendered essentially immobile and entrapped within the ceramic powder coating's voids and surfaces by removal of the solvent used to from the application mixture. The objects of this invention are achieved through the infusion of selected materials that are chemically inert, with respect to the ceramic and with respect to themselves. Generally, these will be long chain hydrocarbons or substantially hydrocarbon polymeric materials having chemically non-reactive groups incorporated thereto. Materials which fulfill the requirements are, for example the non-reactive varieties of: (a) poly (acrylonitrile butadiene styrene) copolymers; (b) poly (acrylic styrene acrylonitrile) copolymers; (c) polyethylene; (d) polypropylene; (e) poly (styrene acrylonitrile) copolymers; (f) polystyrenes; (g) polyphenyl sulfides; (h) poly (phenylene ether phenyl oxide) copolymers; (i) polybutadienes; and (j) polybutenes. Other useful oleophilic and hydrophobic materials of these classes will be apparent to those skilled in the chemical and polymeric sciences and based on the elements of this invention herein disclosed.

Figure 6:
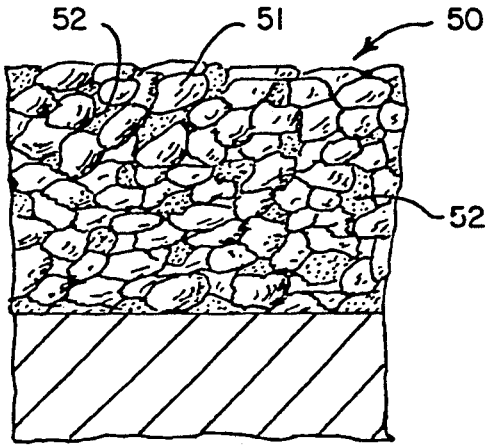
FIG. 6 is an enlarged illustration of a section through the microporous ceramic layer to show the location of the oleophilic and hydrophobic reaction product.

FIG. 6 of the drawings illustrates the manner in which the oleophilic and hydrophobic material is infused into the interstitial voids formed by the ceramic coating. In FIG. 6, numeral 50 indicates generally the composite wear resistant layer, while numeral 51 identifies the particles of ceramic material and numeral 52 the infused oleophilic and hydrophobic organic material. For a maximum useful life it is preferred that the entire interconnecting network of voids formed by the deposited ceramic layer be infused substantially completely throughout the volume of the layer.

Notwithstanding certain general or specific material disclosure of oleophilic and hydrophobic materials that are suitable to the practice of this invention, the important criterion for the resulting roller's use as a lithographic inking roller can be more-or-less predicted by measuring the degree to which droplets of ink oil and of water will spontaneously spread out on the surface of the infused roller. The sessile drop technique as described in standard surface chemistry textbooks is suitable for measuring this quality. Generally, oleophilic and hydrophobic roller materials will have an ink oil (Flint Ink Co.) contact angle of nearly 0° and a distilled water contact angle of about 90° or higher and these values serve to define an oleophilic and hydrophobic material.

I have found, for instance, that the following rules are constructive in but not restrictive for selecting materials according to this principle:

Best: Water contact angle 90° or higher. Ink Oil contact angle 10° or lower and spreading.

Maybe Acceptable: Water contact angle 80° or higher. Ink Oil contact angle 10° or lower and spreading.

Probably Not Acceptable: Water contact angle less than about 80°. Ink Oil contact angle greater than 10° and/or non-spreading.

Materials that have this oleophilic and hydrophobic property as defined herein will in practice in a lithographic printing press configuration accept, retain and maintain lithographic ink on their surface in preference to water or dampening solution when both ink and water are presented to or forced onto that surface. And it is this combined oleophilic and hydrophobic property that allows rollers used in lithographic press inking roller trains to assist in the transport of ink from an ink reservoir to the substrate being printed without loss of printed-ink density control due to debonding of the ink by water from one or more of the inking rollers.

I claim:

1. A wear-resistant ink metering roller possessing oleophilic and hydrophobic properties comprising:

a. a base roller of preselected strength, diameter and length having an outer surface of substantially cylindrical shape;

b. a substantially continuous microporous ceramic layer integral to the outer surface of said base roller, said microporous ceramic layer defining an interconnecting network of openings that permeate substantially the entire volume of said ceramic layer, said openings defining a void volume in said microporous ceramic layer; and c. said void volume being substantially filled by an oleophilic and hydrophobic substantially solid organic material selected from the group consisting of:
poly (acrylonitrile butadiene styrene) copolymers;
poly (acrylic styrene acrylonitrile) copolymers;
polyethylene;
polypropylene;
poly (styrene acrylonitrile) copolymers;
polystyrenes;
polyphenyl sulfides;
polyphenylene sulfides;
poly (phenylene ether phenyl oxide) copolymers;
polybutadienes;
polybutenes; and d. said microporous ceramic layer containing said organic material being oleophilic and hydrophobic and said microporous ceramic layer having a plurality of thin coatings of ceramic material, each of said thin coatings being infused only with said organic material.

2. An ink metering roller as defined in claim 1, wherein said microporous ceramic layer is from about 3 to 8 mils thick.

3. An ink metering roller as defined in claim 1, wherein said oleophilic and hydrophobic chemically non-reactive organic material is poly (acrylonitrile butadiene styrene) copolymers.

4. An ink metering roller as defined in claim 1, wherein said oleophilic and hydrophobic chemically non-reactive organic material is poly (acrylic styrene acrylonitrile) copolymers.

5. An ink metering roller as defined in claim 1, wherein said oleophilic and hydrophobic chemically non-reactive organic material is polyethylene.

6. An ink metering roller as defined in claim 1, wherein said oleophilic and hydrophobic chemically non-reactive organic material is polypropylene.

7. An ink metering roller as defined in claim 1, wherein said oleophilic and hydrophobic chemically non-reactive organic material is poly (styrene acrylonitrile) copolymers.

8. An ink metering roller as defined in claim 1, wherein said oleophilic and hydrophobic chemically non-reactive organic material is polystyrenes.

9. An ink metering roller as defined in claim 1, wherein said oleophilic and hydrophobic chemically non-reactive organic material is polyphenyl sulfides.

10. An ink metering roller as defined in claim 1, wherein said oleophilic and hydrophobic chemically non-reactive organic material is polyphenylene sulfides.

11. An ink metering roller as defined in claim 1, wherein said oleophilic and hydrophobic chemically non-reactive organic material is poly (phenylene ether phenyl oxide) copolymers.

12. An ink metering roller as defined in claim 1, wherein said oleophilic and hydrophobic chemically non-reactive organic material is polybutadienes.

13. An ink metering roller as defined in claim 1, wherein said oleophilic and hydrophobic chemically non-reaction organic material is polybutenes.

14. In a process for producing a wear resistant ink metering roller possessing oleophilic and hydrophobic properties the steps comprising:

a. providing a base roller having a substantially cylindrical surface layer formed of a microporous ceramic material which defines an interconnecting network of openings that permeate substantially the entire volume of the microporous layer, said openings defining a void volume in said microporous ceramic layer; and b. infusing the interconnecting network with a solute having at least one substantially solid oleophilic and hydrophobic organic material selected from the group consisting of:
poly (acrylonitrile butadiene styrene) copolymers;
poly (acrylic styrene acrylonitrile) copolymers;
polyethylene;
polypropylene;
poly (styrene acrylonitrile) copolymers;
polystyrenes;
polyphenyl sulfides;
polyphenylene sulfides;
poly (phenylene ether phenyl oxide) copolymers;
polybutadienes;
polybutenes; and c. removing a solution from the infused solute to thereby solidify said at least one organic material in said void volume thereby causing said microporous ceramic layer to be oleophilic and hydrophobic;

d. said microporous ceramic layer being deposited on the base roller in successive thin incremental layers, each layer being infused only with said at lest one organic material immediately following the deposition of the respective layer.

15. A keyless lithographic printing press system utilizing at least an oil based ink comprising:

a. a base roller of preselected strength, diameter and length having an outer surface of substantially cylindrical shape;

b. a substantially continuous microporous ceramic layer integral on the outer surface of said base roller, said microporous layer defining an interconnecting network of openings that permeate substantially the entire volume of said ceramic layer, said openings defining a void volume in said microporous ceramic material; and c. said void volume being substantially filled by an oleophilic and hydrophobic substantially solid organic material selected from the group consisting of:

poly (acrylonitrile butadiene styrene) copolymers;
poly (acrylic styrene acrylonitrile) copolymers;
polyethylene;
polypropylene;
poly (styrene acrylonitrile) copolymers;
polystyrenes;
polyphenyl sulfides;
polyphenylene sulfides;
poly (phenylene ether phenyl oxide) copolymers;
polybutadienes;
polybutenes; and d. scraper means mounted in a reverse-angle relationship contact with said infused microporous ceramic coated base roller to at least remove excess ink therefrom;

e. said microporous ceramic layer containing said organic material being oleophilic and hydrophobic and said microporous ceramic layer having a plurality of thin coatings of ceramic material, each of said thin coatings being infused only with said organic material.

* * * * *